US006100807A

United States Patent [19]

Orr

[11] Patent Number: 6,100,807

[45] Date of Patent: Aug. 8, 2000

[54] RACK PROTECTION MONITOR

[75] Inventor: Stanley G. Orr, Wheaton, Ill.

[73] Assignee: The United States of America as represented by the United States Department of Energy, Washington, D.C.

[21] Appl. No.: 09/176,256

[22] Filed: Oct. 21, 1998

[51] Int. Cl.[7] ..... G08B 21/00

[52] U.S. Cl. ..... 340/635; 340/644; 340/521; 340/584; 335/106; 335/166; 335/186

[58] Field of Search ..... 340/635, 644, 340/521, 529, 584; 335/166, 186, 106

[56] References Cited

U.S. PATENT DOCUMENTS

| | | | |
|---|---|---|---|
| 3,671,760 | 6/1972 | Holmes | 340/635 |
| 4,195,288 | 3/1980 | Morton | 340/539 |
| 4,989,160 | 1/1991 | Garrett et al. | 364/509 |

*Primary Examiner*—Julie Lieu
*Attorney, Agent, or Firm*—Mark P. Dvorscak; Bradley W. Smith; William R. Moser

[57] ABSTRACT

A hardwired, fail-safe rack protection monitor utilizes electromechanical relays to respond to the detection by condition sensors of abnormal or alarm conditions (such as smoke, temperature, wind or water) that might adversely affect or damage equipment being protected. When the monitor is reset, the monitor is in a detection mode with first and second alarm relay coils energized. If one of the condition sensors detects an abnormal condition, the first alarm relay coil will be de-energized, but the second alarm relay coil will remain energized. This results in both a visual and an audible alarm being activated. If a second alarm condition is detected by another one of the condition sensors while the first condition sensor is still detecting the first alarm condition, both the first alarm relay coil and the second alarm relay coil will be de-energized. With both the first and second alarm relay coils de-energized, both a visual and an audible alarm will be activated. In addition, power to the protected equipment will be terminated and an alarm signal will be transmitted to an alarm central control. The monitor can be housed in a separate enclosure so as to provide an interface between a power supply for the protected equipment and the protected equipment.

4 Claims, 2 Drawing Sheets

RACK PROTECTION MONITOR

CONTRACTUAL ORIGIN OF THE INVENTION

The United States Government has rights in this invention pursuant to Contract No. DE-AC02-76CH03000 between the United States Department of Energy and the University Research Association.

BACKGROUND OF THE INVENTION

1. Field of the Invention

This invention relates to a rack protection monitor, and more particularly, to a new and improved fail-safe rack protection monitor utilizing electromechanical relays to provide warning alarms and to control the power to electronic equipment in the event of the detection of an abnormal or alarm condition.

2. Background of the Invention

Electronic systems for research and the like typically are installed in relay racks. These systems tend to be expensive and complex. Data acquisition subracks and their power supplies is one example of such electronic systems. As a result, protection systems need to be provided to protect these systems in the event an abnormal or possibly damaging trouble condition occurs. In this regard, such protection systems need to monitor such conditions as smoke, temperature, ventilation and water. If an abnormal condition occurs that might damage the equipment being protected, then the protection monitor system should provide warning alarms (for example, visual and audible alarms); turn off the power to the equipment being protected; and in certain cases, provide a warning or alarm information to a central control. However, it is advantageous not to use electronics or software within the protection monitor so that the protection monitor is fail-safe and hardwired.

Accordingly, it is an object of the present invention to provide a new and improved rack protection monitor to protect electronic equipment from abnormal or alarm conditions that might damage the equipment.

It is another object of the present invention to provide a new and improved hardwired, fail-safe rack protection monitor to protect equipment from abnormal or alarm conditions that might damage the equipment, such monitor utilizing electromechanical relays to monitor abnormal conditions that might affect the equipment and to initiate warning alarms upon the detection of such abnormal conditions.

It is still another object of the present invention to provide a new and improved rack protection monitor that utilizes electromechanical relays in connection with the monitoring of abnormal conditions that might damage the equipment being monitored so that a first warning alarm is provided in response to the detection of a first abnormal condition and a second warning alarm is provided in response to the detection of more than one abnormal condition occurring at the same time.

It is yet another object of the present invention to provide a new and improved rack protection monitor that utilizes electromechanical relays in connection with the monitoring of abnormal conditions that might damage the equipment being monitored so that power to the equipment is terminated and an alarm signal to a central control is transmitted in response to the detection of more than one abnormal condition occurring at the same time.

It is still a further object of the present invention to provide a new and improved chassis to house as an independent unit a rack protection monitor that utilizes electromechanical relays in connection with the monitoring of abnormal conditions that might damage the equipment being monitored.

SUMMARY OF THE INVENTION

In accordance with these and many other objects of the present invention, a rack protection monitor embodying the present invention utilizes electromechanical relays to detect abnormal or alarm conditions that might adversely affect or damage equipment being protected. The rack protection monitor includes a series of redundant condition sensors to detect abnormal conditions (for example, two sensors for each such condition). These condition sensors are used to detect such conditions as smoke, temperature, wind or water that might occur around the equipment being protected and each such condition sensor has a normally closed state.

A power supply to convert alternating current to direct current provides the power for the monitor, but additionally an optional back-up battery can be provided to maintain power to the monitor even in a power outage situation. The monitor is initialized when a reset switch is closed to energize reset relay coils and thereby close normally open reset relay contacts. The closing of these reset relays contacts will energize through each of the condition sensors a sensor relay coil associated with each condition sensor. The sensor relay coils will be latched energized by the closing of a sensor relay contact associated with the sensor relay coil. When the reset relay contacts are closed and/or when the sensor relay contacts are closed, green chassis lights will be illuminated corresponding to each of the condition sensors to indicate that the condition sensor is its normal detecting state. Once the monitor is reset, the reset switch is released and the monitor is in a detection mode. While in this detection mode, an alarm control circuit in conjunction with first and second alarm circuits control the energization respectively first and second alarm relay coils. As long as both of those first and second alarm relay coils are energized, an alarm circuit maintains inactive a visual alarm (a flashing light) and an audible alarm (a buzzer or horn).

If one of the condition sensors detects an abnormal condition, the condition sensor will open resulting in the deactivation of its sensor relay coil. The green light associated with that condition sensor will be turned off and a red light associated with that condition sensor will be illuminated. With the detection of this first abnormal condition, the alarm control circuit in conjunction with the first alarm circuit de-energizes the first alarm relay coil, but the alarm control circuit in conjunction with the second alarm circuit maintains the second alarm relay coil energized. This results in the alarm circuit activating both a visual and an audible alarm. Until this first abnormal condition no longer exists and the reset switch is actuated (closed), the alarms will be maintained. Once the first abnormal condition dissipates and the reset switch is actuated, the monitor will revert to its detection mode without any alarms being activated.

On the other hand, if a second alarm condition is detected by another one of the condition sensors while the first condition sensor is still detecting the first alarm condition, the sensor relay coils for both of those condition sensors will be de-energized so that the chassis green lights for both of those condition sensors will be turned off and the chassis red lights for both of those condition sensors will be illuminated. The alarm control circuit in conjunction with the first alarm circuit will de-energize the first alarm relay coil and the alarm control circuit in conjunction with the second alarm circuit will de-energize the second alarm relay coil. With both the first and second alarm relay coils de-energized, the alarm circuit will activate both a visual and an audible alarm. These alarms will be maintained as long as both of the abnormal conditions are being detected by the condition sensors. In fact, the alarms will be maintained to indicate such a serious condition (two alarm condition) even if the reset switch is closed and opened. In addition, an alarm output circuit will open an alarm relay contact turning off the power to the equipment and will close an additional alarm relay contact so that an alarm will be transmitted to an alarm central control.

In one preferred embodiment of the present invention, the rack protection monitor is disposed in a relatively small or compact chassis to that the rack protection monitor can be a self-contained unit that acts as an interface between the protected equipment and the power being supplied to the equipment. The chassis is adequately ventilated so that abnormal conditions such as wind, temperature and smoke can be detected by the monitor lodged within the chassis.

BRIEF DESCRIPTION OF THE DRAWINGS

These and many other objects and advantages of the present invention will become readily apparent from consideration of the following detailed description of the embodiment of the invention shown in the accompanying drawings wherein.

DETAILED DESCRIPTION OF THE PREFERRED EMBODIMENT

Figure 1:
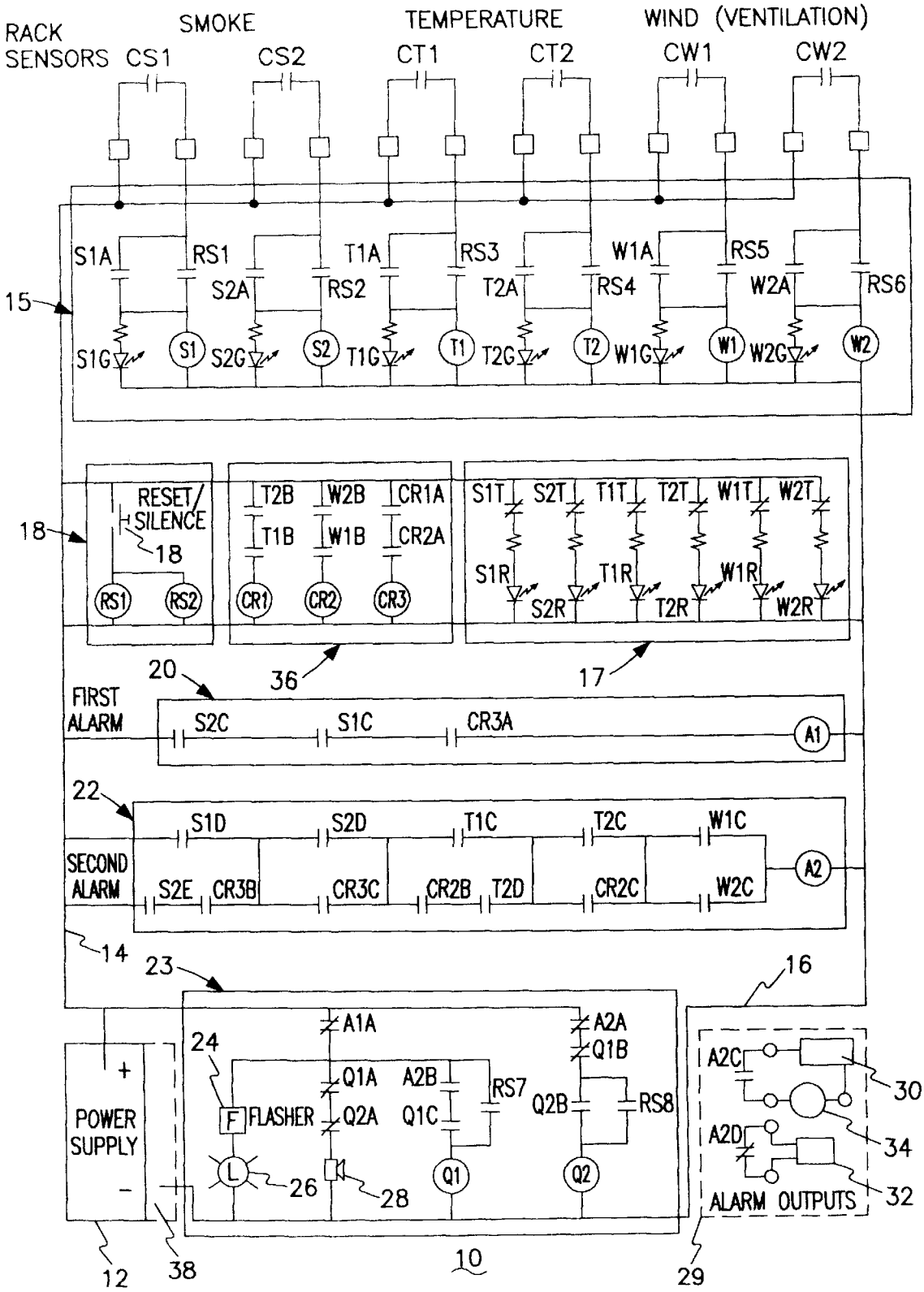
FIG. 1 is a schematic diagram of rack protection monitor embodying the present invention.

Referring now more specifically to FIG. 1, therein is disclosed a schematic diagram of rack protection monitor that is generally designated by the reference numeral 10 and that embodies the present invention. The rack protection monitor includes a series of condition sensors CS1, CS2, CT1, CT2, CW1, and CW2 that are adapted to detect abnormal conditions. These condition sensors CS1, CS2, CT1, CT2, CW1, and CW2 are closed contacts when a normal condition exists and are open contacts when an abnormal condition is detected. A power supply 12 provides 24 VDC power across conductors 14 and 16 (the conductor 14 being at a relatively positive potential compared to the conductor 16). The monitor 10 is initialized when a reset switch 18 is closed to energize reset relay coils RS1 and RS2.

With the energization of the reset coils RS1 and RS2, reset relay contacts RS1–RS8 are closed (in connection with the description of the monitor 10 in FIG. 1, the reference numerals or designations for each of the relay contacts includes as its first two or three digits the reference designation of the particular relay coil that is associated with or controls the condition of the relay contact). Power from the conductors 14 and 16 is provided to the sensor relay coils S1, S2, T1, T2, W1, and W2 through their respective condition sensors CS1, CS2, CT1, CT2, CW1, and CW2 so that sensor relay coils S1, S2, T1, T2, W1, and W2 are all energized. As a result, relay contacts S1A–S1D, S2A–S2E, T1A–T1C, T2A–T2D, W1A–W1C, and W2A–W2C are closed from their normally open state such that green chassis lights S1G, S2G, T1G, T2G, W1G, and W2G are illuminated; relay coils CR1 and CR2 are energized closing relay contacts CR1A and CR2A–CR2C so that relay coil CR3 also is energized and its associated relay contacts CR3A–CR3C are closed; and relay contacts S1T, S2T, T1T, T2T, W1T, and W2T are opened from their normally closed state such that red chassis lights SR, S2R, T1R, T2R, W1R, and W2R remain off. With the closing of relay contacts S2C, S1C and CR3A, all of the relay contacts in a first alarm circuit 20 are closed so that an alarm coil A1 is energized and with the closing of relay contacts S1D, S2D, T1C, T2C, W1C, S2E, CR3B, CR3C, CR2B, T2D, CR2C and W2C, all of the relay contacts in a second alarm circuit 22 are closed so that an alarm coil A2 is energized. The energization of the alarm coils A1 and A2 results in the opening of relay contacts A1A and A2A in an alarm circuit 23 so that a flasher 24 will not activate a light 26 and a buzzer 28 will not be sounded; results in the closing of a relay contact A2C in an alarm output circuit 29 so that 120 VAC power is supplied to protected equipment 30; and results in the opening of a relay contact A2D in the alarm output circuit 29 so that no alarm is transmitted to a central control 32. The power being supplied to the protected equipment 30 is provided through the closed relay contact A2D and an undervoltage release 34 that terminates the supplying of the power to the protected equipment 30 in the event the voltage of the supplied power falls below an acceptable level. One such type of undervoltage release can be a circuit breaker model MULTI 9 NC100H series manufactured by the Square D Company. Referencing FIG. 1, the group of electrical elements depicted by item 15 are termed a sensor circuit. Similarly, the group of electrical elements depicted by item 17 are termed a warning light circuit.

Once the monitor 10 is so reset, the reset switch 18 is released and the monitor 10 is in a detection mode.

While in this detection mode, an alarm control circuit 36 in conjunction with the first alarm circuit 20 and the second alarm circuit 22 maintain energized the alarm relay coils A1 and A2. As long as both of those alarm relay coils A1 and A2 are energized, the visual alarm consisting of the flasher 24 and the flashing light 26 and the audible alarm consisting of the buzzer or horn 28 are maintained inactive by the alarm circuit 23; power is supplied to the protected equipment 30 through the closed relay contact A2C and no alarm signal is transmitted to the central control 32 due to the opening of the relay contact A2D.

The mode of the monitor 10 will change if any one of the condition sensors CS1, CS2, CT1, CT2, CW1, and CW2 detects an abnormal condition. If this detection is of only one or a first abnormal condition occurring at one time, the first alarm circuit 20 in conjunction with the alarm control circuit 36 de-energizes the first alarm relay coil A1, but the second alarm circuit 22 in conjunction with the alarm control circuit 36 will maintain the second alarm relay coil A2 energized. This results in the activation of both the flashing light 26 and the buzzer 28 in the alarm circuit 23. Until this first abnormal condition no longer exists and the reset switch 18 is closed, the light 26 will continue to flash and the horn 28 will continue to be sounded. However, the power to the protected equipment 30 will continue to be provided as long as the first abnormal condition is the only one being detected at a particular time and no alarm signal will be transmitted to the central control 32.

If a second alarm condition is detected by another one of the condition sensors CS1, CS2, CT1, CT2, CW1, and CW2 while the first alarm condition still exists, the sensor relay coils for both of those condition sensors will be de-energized so that the chassis green lights for both of those sensors will be turned off and the red lights for both of those condition sensors will be illuminated. The alarm control circuit 36 together with the first alarm circuit 20 will de-energize the first alarm relay coil A1 and the alarm control circuit 36 together with the second alarm circuit 22 will de-energize the second alarm relay coil A2. With both the first alarm relay coil A1 and the second alarm relay coil A2 de-energized, both the flashing light 26 and the buzzer 28 will be activated by the alarm circuit 23. These alarms will be maintained as long as the both of the abnormal conditions are being detected by the condition sensors. In fact, the alarms will be maintained to indicate such a serious condition (two alarm condition) even after the reset switch 18 is pushed and released. In addition, the second alarm relay contact A2C in the alarm output circuit 29 will open turning off the power to the protected equipment 30 and the additional second alarm relay contact A2D in the alarm output circuit 29 will close so that an alarm signal will be transmitted to the alarm central control 32.

In the case of the monitor 10, condition sensors CS1 and CS2 can be used to detect abnormal smoke conditions, condition sensors CT1 and CT2 can be used to detect abnormal temperature conditions, and condition sensors CWl and CW2 can be used to detect abnormal wind or ventilation conditions. On the other hand, the condition sensors CS1, CS2, CT1, CT2, CW1, and CW2 can be adapted to detect any other type of physical condition such as moisture or water. In order to provide further details as to the operation of the monitor 10 in protecting equipment 30 from abnormal conditions being sensed by the condition sensors CS1, CS2, CT1, CT2, CW1, and CW2 in the monitor 10, the operation of the monitor 10 is being described hereinafter when a first abnormal wind condition is sensed by the condition sensor CW2 and when thereafter a second abnormal temperature is sensed by the condition sensor CT2 while the first abnormal wind condition is still being detected by the condition sensor CW2.

Power Supply

The power for the monitor 10 is provided by the power supply 12. The power supply 12 converts standard 120 VAC power to 24 VDC power that is distributed to the various components of monitor 10 through the conductors 14 and 16 (the conductor 14 being at a relatively positive potential as compared to the conductor 16). Optionally, a backup battery 38 can be incorporated into the power supply 12 to supply the monitor 10 with the 24 VDC power even during a power outage. Consequently, the monitor 10 continues to monitor and protect the electronic equipment 30 being monitored and protected even if a power outage results in 120 VAC power not being supplied to the power supply 12.

Reset/Initialization

In order to initialize the monitor 10 so that it is placed into its detection mode or state, the reset switch 18 is closed such that power from the conductors 14 and 16 is supplied through the closed reset switch 18 so that the reset relay coils RS1 and RS2 are energized. All of the normally open reset relay contacts RS1–RS8 are thereby closed. Power is supplied from the conductors 14 and 16 to the sensor relay coils S1, S2, T1, T2, W1 and W2 through their respective closed condition sensors CS1, CS2, CT1, CT2, CW1, and CW2 and through their respective closed reset relay contacts RS1–RS6 resulting in the energization of the sensor relay coils S1, S2, T1, T2, W1, and W2 and their corresponding chassis green indicator lights (light emitting diodes—LED's) S1G, S2G, T1G, T2G, W1G and W2G. With the sensor relay coils S1, S2, T1, T2, W1, and W2 energized, relay contacts S1A, S2A, T1A, T2A, W1A, and W2A are closed so that the sensor relay coils S1, S2, T1, T2, W1, and W2 will be latched energized even after the reset switch 18 is opened and the reset contacts RS1–RS6 revert to their normally open state; a relay coil CR3 in the alarm control circuit 36 is energized (a relay coil CR1 is energized through closed relay contacts T2B, T1B and a relay coil CR2 is energized through closed relay contacts W2B and W1B such that the relay coil CR3 is energized through the now closed contacts CR1A and CR2A); and normally closed contacts S1T, S2T, T1T, T2T, W1T and W2T are opened so that the red indicator lights (light emitting diodes—LED's) S1R, S2R, T1R, T2R, W1R and W2R remain turned off. In addition, the first alarm circuit 20 supplies power from the conductor 14 to the first alarm relay coil A1 so that it is energized due to the fact that the relay contacts S2C, S1C and CR3A are all closed and the second alarm circuit 22 supplies power from the conductor 14 to the second alarm relay coil A2 such that it is energized due to the fact that the relay contacts S1D, S2D, T1C, T2C, W1C, S2E, CR3B, CR3C, CR2B, T2D, CR2C and W2C are all closed.

The energization of the first alarm relay coil A1 and the second alarm relay coil A2 results in the opening of relay contacts A1A and A2A in the alarm circuit 23. As a result, the light 26 will not be illuminated and the buzzer 28 will not be sounded. In addition, the relay contact A2C in the alarm output circuit 29 will be closed so that 120 VAC power is supplied to the protected equipment 30 and the relay contact A2D in the alarm output circuit 29 will be opened so that no alarm signal is transmitted to the central control 32.

The resetting or initialization of the monitor 10 is completed with the release or opening of the reset switch 18. The opening of the reset switch 18 results in the de-energization of the reset coils RS1 and RS2 so that the reset relay contacts RS1–RS8 revert to their normally opened states. However, the sensor relay coils S1, S2, T1, T2, W1, and W2 are latched energized by their associated closed relay contacts S1A, S2A, T1A, T2A, W1A, and W2A, respectively. Consequently, the remaining components of the monitor 10 will remain in the same state as when the reset switch 18 was closed so that the monitor 10 will now be in its monitoring or detection mode.

First Alarm Condition

The monitor 10 is designed to react to a first abnormal or alarm condition being sensed by one of the condition sensors CS1, CS2, CT1, CT2, CW1, and CW2 (for example, an abnormal ventilation or wind condition detected by the condition sensor CW2) so that a light 26 is flashed by the flasher 24, the buzzer 28 is sounded, the green light W2G is turned off, and the red light W2R is illuminated. However, power is still maintained to the protected equipment 30 and no alarm signal is transmitted to the central control 32. As indicated above and in order to provide details of the operation of the monitor 10 when an abnormal condition is detected, the following explanation details what occurs when such a first alarm condition is detected by the wind condition sensor CW2.

The condition sensor CW2 is normally closed as long as the wind/ventilation being sensed by it is within a normal range. If that condition changes such that the wind being sensed by the condition sensor CW2 is not within a normal range, the condition sensor CW2 opens. The opening of the condition sensor CW2 results in the de-energization of the sensor relay coil W2 because power from the conductor 14 is no longer supplied to the sensor relay coil W2 through the now opened condition sensor CW2.

With the sensor relay coil W2 de-energized, the relay contact W2A reverts to its normally open state and the green light W2G is turned off. On the other hand, normally closed relay contact W2T reverts to its normally closed state so that the red light W2R becomes illuminated to indicate that the condition sensor CW2 has sensed an abnormal wind/ventilation condition. The de-energization of the sensor relay coil W2 also results in the de-energization of the first alarm relay coil Al, but the second alarm relay coil A2 is maintained energized. In this regard, the de-energization of the sensor relay coil W2 will cause the relay contact W2B to revert to its normally open condition such that the relay coil CR2 becomes de-energized. This de-energization of the relay coil CR2 results in the relay contact CR2A also to revert to its normally open condition thereby de-energizing the relay coil CR3. With the de-energization of the relay coil CR3, the relay contact CR3A is restored to its normally open condition such that the first alarm circuit 20 no longer supplies power from the conductor 14 to the first alarm relay coil Al and the first alarm relay coil Al becomes de-energized.

On the other hand, the second alarm circuit 22 still maintains power to the second alarm relay coil A2 even though relay contacts CR3B, CR3C, CR2B, CR2C and W2C revert to their normally open state with the de-energization of the relay coils CR2, CR3, and W2. This is because power from the conductor 14 is applied to the second alarm relay coil A2 through the still closed contacts S1D, S2D, T1C, T2C and W1C. Hence, the alarm control circuit 36 in conjunction with the first alarm circuit 20 and the second alarm circuit 22 provides a hardwired algorithm that in response to the detection of a single abnormal condition by any one of the condition sensors CS1, CS2, CT1, CT2, CW1, and CW2 de-energizes the first alarm coil Al and maintains the second alarm coil A2 energized.

The de-energization of the first alarm relay coil A1 and the maintaining of the second alarm relay coil A2 energized results in the light 26 being flashed by the flasher 24 and the buzzer 28 being sounded. As long as the second alarm relay coil A2 is maintained energized, the relay contact A2A is opened thereby ensuring that the relay coil Q2 will remain de-energized and the relay contact Q2A will be in its normally closed state. On the other hand, relay contact A1A will revert to its normally closed condition with the de-energization of the first alarm coil A1 so that power from the conductor 14 will be supplied through the closed relay contact A1A and the flasher 24 to the light 26 such that the light 26 will begin to flash on and off to indicate an alarm condition. The relay coil Q1 also will remain de-energized due to the fact that the normally open relay contact Q1C remains open such that the relay contact Q1A will remain in its normally closed state. With both of the relay contacts Q1A and Q2A in their normally closed states, power will also be supplied from the conductor 14 through the closed relay contacts A1A, Q1A and Q2A to the buzzer 28 causing the buzzer 28 to be sounded. As a result, both a visible alarm (the flashing light 26) and an audible alarm (the buzzer 28) will be provided by the monitor 10 in response to the sensing of an abnormal condition by the condition sensor CW2 (or any one of the other condition sensors CS1, CS2, CT1, CT2, and CW1).

The power to the protected equipment 30 will not be affected when only one condition sensor (in this explanation, the condition sensor CW2) detects an abnormal condition because the second alarm relay coil A2 is maintained energized. With the second alarm relay coil A2 energized, the relay contact A2C remains closed so that power is normally supplied to the protected equipment 30 through the closed contact A2C and the undervoltage release 34. On the other hand, the normally closed relay contact A2D is opened so that no alarm signal is transmitted to the central control 32.

Reset After First Alarm Condition

After the first alarm condition occurs and is detected by the condition sensor CW2, the light 26 will continue to flash and the buzzer 28 will continue to be sounded until the reset switch 18 is actuated (closed). This is the case even if the sensed abnormal condition clears before the reset switch 18 is actuated. In the event that the sensed abnormal condition clears before the reset switch 18 is actuated, power from the conductor 14 still will not be supplied to the sensor relay coil W2 because both the relay contact W2A and the reset contact RS6 remain open. As long as the sensor relay coil W2 remains de-energized, the first alarm mode remains as if the condition sensor CW2 is still sensing an abnormal condition. The first alarm mode and the alarms provided by the alarm circuit 23 will continue until the reset switch 18 is closed.

Two different results occur when the reset switch 18 is actuated after a first alarm mode depending on whether the alarm condition is still present. In the event the alarm condition is still present so that the condition sensor CW2 is still open, the closing of the reset switch 18 resulting in the energization of the relay coils RS1 and RS2 and the closing of the relay contact RS6 will nevertheless not enable the energization of the sensor relay coil W2 because power to the sensor relay coil W2 only can be supplied through the closed condition sensor CW2. As a result, the green light W2G remains off, the red light W2R remains illuminated, the first alarm relay coil Al remains de-energized and the second alarm relay coil A2 remains energized. The energization of the relay coils RS1 and RS2 will cause relay contact RS8 to close, but the relay coil Q2 will remain de-energized due to the open relay contact A2A. On the other hand, the closing of the reset contact RS7 will provide power to the relay coil Q1 from the conductor 14 through the closed contacts A1A and RS7. With the relay coil Q1 energized, the relay contact Q1A opens so that no power is supplied to the buzzer 28 terminating the audible alarm. However, power is still supplied through the closed relay contact A1A and the flasher 24 to the light 26 so the light 26 continues to flash.

This condition of the flashing light 26 and the buzzer 28 will remain after the reset switch 18 is released. The release (opening) of the reset switch 18 will de-energize the relay coils RS1 and RS2 such that both of the relay contacts RS7 and RS8 will revert to their normally opened states. The relay coil Q2 will remain de-energized because the relay contact A2A remains open while the relay coil Q1 remains energized through the closed contacts A1A, A2B and Q1C. With the relay coil Q1 energized, the relay contact Q1A remains opened thereby keeping the buzzer 28 from receiving power from the conductor 14 through the closed relay contact A1A.

In the event that the first alarm condition has cleared (i.e., the condition being sensed by the condition sensor CW2 is no longer abnormal and the condition sensor CW2 is closed) when the reset switch 18 is actuated, the closing of the reset contact RS6 will result in the energization of the sensor relay coil W2 so that all of the condition sensors CS1, CS2, CT1, CT2, CW1, and CW2 will be energized. The monitor 10 then will be reset to its detection mode and will remain in that mode after the reset switch 18 is released (opened). When the monitor 10 is in this detection mode, no alarm signals will be provided.

Second Alarm Condition

In the event that a second abnormal or alarm condition is sensed by one of the condition sensors CS1, CS2, CT1, CT2, CW1, and CW2 (for example, an abnormal temperature condition detected by the condition sensor CT2) while the first abnormal or alarm condition is still occurring and is being detected by one of the other condition sensors CS1, CS2, CT1, CT2, CW1, and CW2, the light 26 is flashed by the flasher 24, the buzzer 28 is sounded, the green lights associated with the condition sensors detecting an abnormal condition are turned off and the red lights associated with those condition sensors are illuminated to indicate which of the condition sensors CS1, CS2, CT1, CT2, CW1, and CW2 are detecting an abnormal condition, the power to the protected equipment 30 is turned off and an alarm signal is transmitted to the central control 32. As indicated above and in order to provide details of the operation of the monitor 10 when at least two abnormal conditions are detected, the fol30 lowing explanation details what occurs when such a first alarm condition is detected by the wind condition sensor CW2 and a second alarm condition is detected by the temperature condition sensor CT2. While this explanation is being made with respect to the detection of two different conditions (i.e., wind and temperature), the monitor 10 reacts to any combination of at least two of the condition sensors CS1, CS2, CT1, CT2, CW1, and CW2 that are sensing an abnormal condition even if the condition sensors are the redundant condition sensors for the same condition. In this latter regard, the purpose of having redundant condition sensors for each of the different conditions being detected is to ensure that the alarm circuit 29 does not terminate power to the protected equipment 30 or transmit an alarm signal to the central control 32 except when the abnormal condition is confirmed by both of the redundant condition sensors for that condition.

With the first alarm condition still occurring, the condition sensor CW2 is in its open state. The condition sensor CT2 is normally closed as long as the temperature being sensed by it is within a normal range. If that condition changes such that the temperature being sensed by the condition sensor CT2 is not within a normal range, the condition sensor CT2 also opens. With the condition sensor CW2 in its open state, the sensor relay coil W2 remains de-energized because power from the conductor 14 is no longer supplied to the sensor relay coil W2 through the opened condition sensor CW2. In a like manner, the opening of the condition sensor CT2 results in the de-energization of the sensor relay coil T2 because power from the conductor 14 is no longer supplied to the sensor relay coil T2 through the opened condition sensor CT2.

With the sensor relay coil W2 de-energized, the relay contact W2A remains in its normally open state and the green light W2G is turned off and with the sensor relay coil T2 de-energized, the relay contact T2A reverts to its normally open state and the green light T2G is turned off. On the other hand, normally closed relay contact W2T remains in its normally closed state so that the red light W2R is illuminated to indicate that the condition sensor CW2 continues to sense an abnormal wind/ventilation condition and the normally closed relay contact T2T reverts to its normally closed state so that the red light T2R becomes illuminated to indicate that the condition sensor CT2 has sensed an abnormal temperature condition.

The de-energization of the sensor relay coils W2 and T2 also results in the de-energization of the first alarm relay coil Al and the second alarm relay coil A2. In this regard, the continued de-energization of the sensor relay coil W2 maintains the relay contact W2B in its normally open condition such that the relay coil CR2 continues to be de-energized and the de-energization of the sensor relay coil T2 causes the relay contact T2B to revert to its normally open condition such that the relay coil CR1 also becomes de-energized. This de-energization of both of the relay coils CR1 and CR2 results in the relay contacts CR1A and CR2A respectively to revert to their normally open conditions thereby de-energizing the relay coil CR3. With the de-energization of the relay coil CR3, the relay contact CR3A is in its normally open condition such that the first alarm circuit 20 no longer supplies power from the conductor 14 to the first alarm relay coil Al and the first alarm relay coil Al remains de-energized. The de-energization of the relay coils CR2 and CR3 together with the de-energization of the sensor relay coils W2 and T2 results in the de-energization of the second alarm coil A2. This is because the relay contacts T2C, CR3B, CR3C, CR2B, T2D, CR2C and W2C all are now in their normally open states so that no power from the conductor 14 can be supplied to the second alarm coil A2 through the second alarm circuit 22. Hence, the alarm control circuit 36 in conjunction with the first alarm circuit 20 and the second alarm circuit 22 provides a hardwired algorithm that in response to the detection of two abnormal conditions by at least any two of the condition sensors CS1, CS2, CT1, CT2, CW1, and CW2 de-energizes both the first alarm coil Al and the second alarm coil A2.

The de-energization of the first alarm relay coil A1 and the second alarm relay coil A2 results in the light 26 to be flashed by the flasher 24, the buzzer 28 to be sounded, power to the protected equipment 30 to be terminated and an alarm signal being provided to the central control 32. With the de-energization of the first alarm coil A1, the relay contact A1A will be in its normally closed condition so that power from the conductor 14 will be supplied through the closed relay contact A1A and the flasher 24 to the light 26 such that the light 26 will flash on and off to indicate an alarm condition. The relay coil Q1 also will remain de-energized due to the fact that the normally open relay contacts Q1C and A2B remain open and the reset relay contact RS7 is open such that the relay contacts Q1A and Q1B will remain in their normally closed states. With the second alarm relay coil A2 also de-energized, the relay contact A2A reverts to its normally closed state and the relay contact Q1B is in its closed state. However, the relay coil Q2 will remain de-energized due the fact that both of the relay contacts Q2B and RS8 are in their normally open states. As a result, the relay contact Q2A will be in its normally closed state. With both of the relay contacts Q1A and Q2A in their normally closed states, power will also be supplied from the conductor 14 through the closed relay contacts A1A, Q1A and Q2A to the buzzer 28 causing the buzzer 28 to be sounded. As a result, both a visible alarm (the flashing light 26) and an audible alarm (the buzzer 28) will be provided by the alarm circuit 23 in the monitor 10 in response to the sensing of an abnormal condition by the condition sensors CW2 and CT2.

Unlike the situation when only one of the condition sensors CS1, CS2, CT1, CT2, CW1, and CW2 was detecting an abnormal condition, the detecting of at least two abnormal conditions by the condition sensors CS1, CS2, CT1, CT2, CW1, and CW2 will cause the cessation of power being supplied to the protected equipment 30. With the second alarm relay coil A2 de-energized, the relay contact A2C reverts to its normally opened state so that no power can be supplied to the protected equipment 30. On the other hand, the normally closed relay contact A2D will revert to its normally closed state so that an alarm signal is transmitted to the central control 32.

Reset After Second Alarm Condition

After the first and second alarm conditions occur and are detected by the condition sensors CW2 and CT2, the light 26 will continue to flash and the buzzer 28 will continue to be sounded until the reset switch 18 is actuated (closed). This is the case even if the sensed abnormal conditions clear before the reset switch 18 is actuated. In the event that the sensed abnormal conditions clear before the reset switch 18 is actuated, power from the conductor 14 still will not be supplied to neither of the sensor relay coils W2 and T2 because both the relay contact W2A and the reset contact RS6 remain open in the case of the sensor relay coil W2 and both the relay contact T2A and the reset contact RS4 remain open in the case of the sensor relay coil T2. As long as the sensor relay coils W2 and T2 remain de-energized, the second alarm mode remains as if the condition sensors CW2 and CT2 are still sensing an abnormal conditions. As a result, the second alarm mode and the alarms provided by the alarm circuit 23 will continue until the reset switch 18 is closed.

Two different results occur when the reset switch 18 is actuated after a second alarm mode depending on whether the alarm conditions are still present. In the event the alarm conditions are still present so that the condition sensors CW2 and CT2 are still open, the closing of the reset switch 18 resulting in the energization of the relay coils RS1 and RS2 and the closing of among other things the relay contacts RS6 and RS4 will nevertheless not enable the energization of either of the sensor relay coils W2 and T2 because power to the sensor relay coil W2 only can be supplied through the closed condition sensor CW2 and power to the sensor relay coil T2 only can be supplied through the closed condition sensor CT2. As a result, the green lights W2G and T2G remain off, the red lights W2R and T2R remain illuminated, and the first alarm relay coil Al and the second alarm relay coil A2 remain de-energized. The closing of the reset contact RS7 will provide power to the relay coil Q1 from the conductor 14 through the closed contacts A1A and RS7. With the relay coil Q1 energized, relay contact Q1A opens so that no power is supplied from the conductor 14 and the closed contact A1A to the buzzer 28 terminating the audible alarm while the reset switch 18 is closed. However, power continues to be supplied through the closed relay contact A1A and the flasher 24 to the light 26 so the light 26 continues to flash even when the reset switch is closed. The energization of the relay coils RS1 and RS2 due to the closing of the reset switch 18 also will cause the relay contact RS8 to close, but the relay coil Q2 will remain de-energized due to the opening of the relay contact Q1B with the energization of the relay coil Q1.

After the reset switch 18 is released (opened), the light 26 will continue to flash and the buzzer 28 will again be sounded as long as the abnormal conditions are still being sensed by the condition sensors CW2 and CT2.

The release (opening) of the reset switch 18 will de-energize the relay coils RS1 and RS2 such that both of the relay contacts RS7 and RS8 will revert to their normally opened states. The relay coil Q2 will remain de-energized because the relay contact Q2B remains open and the relay coil Q1 will revert to its de-energized state due to the fact that the relay contact A2B is in its normally open state. With the relay coils Q1 and Q2 both de-energized, both of the relay contacts Q1A and Q2A are in their normally closed states so that the buzzer 28 will again be activated because it receives power from the conductor 14 through the closed relay contact A1A and the closed relay contacts Q1A and Q2A.

In the event that the second alarm condition has cleared (i.e., the conditions being sensed by the condition sensors CW2 and CT2 are no longer abnormal and the condition sensors CW2 and CT2 are closed) when the reset switch 18 is actuated, the closing of the reset contacts RS6 and RS4 will result in the energization of the sensor relay coils W2 and T2 so that all of the condition sensors CS1, CS2, CT1, CT2, CW1, and CW2 will be closed and their corresponding sensor relay coils S1, S2, T1, T2, W1, and W2 will be energized. The monitor 10 then will be reset to its detection mode and will remain in that mode after the reset switch 18 is released (opened). When the monitor 10 is in this detection mode, no alarm signals will be provided by the alarm circuit 23.

In the event that one of the second alarm conditions has cleared (i.e., one of the conditions being sensed by the condition sensors CW2 and CT2 is no longer abnormal (for example, the condition being sensed by the condition sensor CT2)), the condition sensor CT2 would be in its closed state when the reset switch 18 is actuated. The closing of the reset contacts RS6 and RS4 will result in the energization of the sensor relay coil T2, but not the sensor relay coil W2 due to the open condition sensor CW2. As a result, the sensor relay coils S1, S2, T1, T2, and W1 will be energized, but the sensor relay coil W2 will remain de-energized. Consequently, the monitor 10 will be in the same mode as was the case when the reset switch 18 was closed and opened following a first alarm condition. In particular, the release (opening) of the reset switch 18 will de-energize the relay coils RS1 and RS2 such that both of the relay contacts RS7 and RS8 will revert to their normally opened states. The relay coil Q2 will remain de-energized because the relay contact A2A will be opened while the relay coil Q1 remains energized through the closed contacts A1A, A2B and Q1C. With the relay coil Q1 energized, the relay contact Q1A remains opened thereby keeping the buzzer 28 from receiving power from the conductor 14 through the closed relay contact A1A. In addition, the relay contact A2D will open thereby terminating the alarm signal to the central control 32 and the relay contact A2C will be closed so that power will be restored to the protected equipment 30.

Monitor Enclosure

Figure 2A:
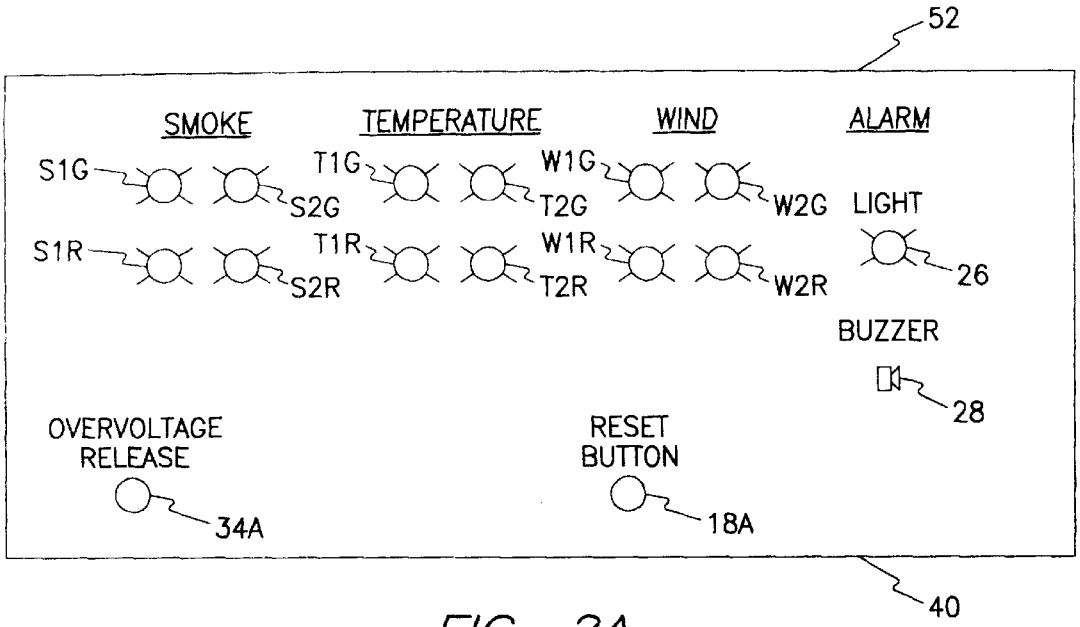
FIG. 2A is a diagrammatic illustration of a front view of a chassis or enclosure within which the rack protection monitor of FIG. 1 can be housed.
Figure 2B:
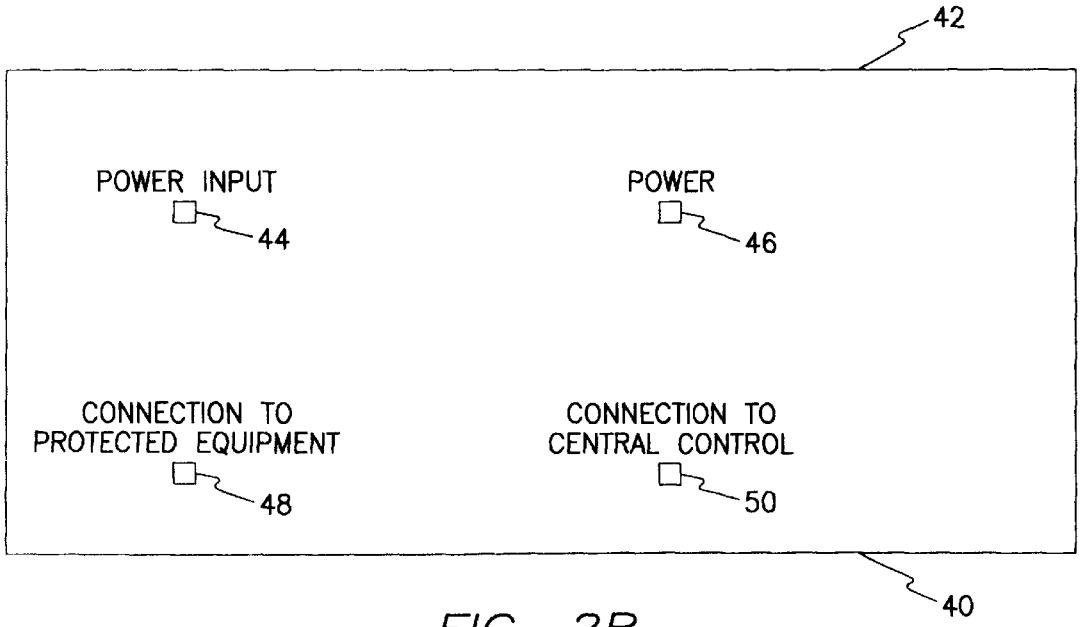
FIG. 2B is a diagrammatic illustration of a rear view of the chassis or enclosure of FIG. 2A.

The monitor 10 is adapted to be disposed in a enclosure or chassis such as the enclosure 40 illustrated in FIGS. 2A and 2B. A rear panel 42 includes a connection 44 for receiving AC power for the power supply 12, a connection 46 for receiving AC power to be supplied to the protected equipment 30, a connection 48 for coupling the protected equipment 30 to the monitor 10 and a connection 50 for coupling the central control 32 to the monitor 10. A front panel 52 of the enclosure 40 includes the various indicator lights and alarms for the monitor 10. Particular ones of the green lights S1G, S2G, T1G, T2G, W1G, and W2G are illuminated when the monitor 10 is activated to indicate which of the condition sensors CS1, CS2, CT1, CT2, CW1, and CW2 are in their normal detection mode not detecting an abnormal condition and particular ones of the red indicator lights S1R, S2R, T1R, T2R, W1R and W2R are illuminated when the monitor 10 is activated to indicate which of the condition sensors CS1, CS2, CT1, CT2, CW1, and CW2 are in their abnormal detection mode detecting an abnormal condition. The alarm flashing light 26 and the buzzer 28 also are mounted on the front panel 52. In order to reset the monitor 10, a reset button 18A is located on the front panel that when actuated closes the reset switch 18. An undervoltage reset switch 34A also is located on the front panel so that the undervoltage release 34 can be reset to its normal state after the voltage level is restored to an acceptable level.

In view of the fact that the monitor 10 can use relative small relay coils and relay contacts (for example, relays with Form C contacts), the entire enclosure 40 can be made relatively small. In addition, the top and bottom (not shown) of the enclosure 40 can include an opening covered by a screen or the like so that the smoke and ventilation detectors can be mounted within the enclosure 40. In such a case, the enclosure 40 can act as a separate interface between a power supply for the protected equipment 30 and the protected equipment 30 itself.

Obviously, many modifications and variations of the present invention are possible in light of the above teachings. Thus, it is to be understood that, within the scope of the appended claims, the invention may be practiced otherwise than as specifically described above.

What is claimed and desired to be secured by Letters Patent of the United States is:

1. A protection monitor for monitoring a plurality of conditions and for protecting equipment, said monitor comprising:

a plurality of condition sensors, each of said condition sensors monitoring one of said plurality of conditions and including an elctromechanical contact in a first condition state when said monitored condition is abnormal and in a second condition state when said monitored condition is normal;

a first alarm relay coil having first and second alarm states;

a second alarm relay coil having first and second alarm states;

a plurality of sensor coils, each of said sensor coils having a first or second sensor state responsive to said first and second condition state of one of said condition sensors and controlling the states of a plurality of electromechanical sensor contacts;

an alarm control including some of said electromechanical sensor contacts and responsive to the condition state of each of said condition sensors for controlling the state of said first alarm relay coil and the state of said second alarm relay coil, said first alarm relay coil being in said first alarm state and said second relay coil being in said second alarm state when one of said sensor coils is in said first sensor state and said first alarm relay coil being in said first alarm state and said second relay coil being in said first second alarm state when at least two of said sensor coils are in said first sensor condition;

an alarm circuit for activating alarms in response to the states of said first and second alarm relay coils; including an enclosure for housing said plurality of condition sensors, said first and second alarm circuits, said alarm control circuit, said enclosure having indicator lights thereon for indicating the states of said sensors to thereby indicate the state of each of said condition sensors, having visual and audible alarms initiated by said alarm control circuit in conjunction with said first and second alarm circuits, and a reset button for causing said alarm control circuit to reset said first and second alarm circuits when all of said condition sensors are not detecting an abnormal condition; and said enclosure having openings so that said condition sensors can detect said monitored conditions.

2. A protection monitor for monitoring a plurality of conditions and for protecting equipment, said monitor comprising:

a plurality of condition sensors, each of said condition sensors monitoring one of said plurality of conditions and including an elctromechanical contact in a first condition state when said monitored condition is abnormal and in a second condition state when said monitored condition is normal;

a first alarm relay coil having first and second alarm states;

a second alarm relay coil having first and second alarm states;

a plurality of sensor coils, each of said sensor coils having a first or second sensor state responsive to said first and second condition state of one of said condition sensors and controlling the states of a plurality of electromechanical sensor contacts;

an alarm control including some of said electromechanical sensor contacts and responsive to the condition state of each of said condition sensors for controlling the state of said first alarm relay coil and the state of said second alarm relay coil, said first alarm relay coil being in said first alarm state and said second relay coil being in said second alarm state when one of said sensor coils is in said first sensor state and said first alarm relay coil being in said first alarm state and said second relay coil being in said first second alarm state when at least two of said sensor coils are in said first sensor condition;

an alarm circuit for activating alarms in response to the states of said first and second alarm relay coils; including an enclosure for housing said plurality of condition sensors, said first and second alarm circuits, said alarm control circuit, said enclosure having indicator lights thereon for indicating the states of said sensors to thereby indicate the state of each of said condition sensors, having visual and audible alarms initiated by said alarm control circuit in conjunction with said first and second alarm circuits, and a reset button for causing said alarm control circuit to reset said first and second alarm circuits when all of said condition sensors are not detecting an abnormal condition; and said enclosure includes power connections for connecting said equipment to said monitor and to connect a supply of power for said monitor.

3. A protection monitor as set forth in claim 1 or 2 including a power control circuit coupled to said second alarm circuit.

4. A protection monitor as set forth in claim 3 wherein said power control circuit terminates power to said protected equipment only upon activation of said second alarm circuit or when said power falls below a predetermined level.

* * * * *